US006637386B2

(12) United States Patent
Murata et al.

(10) Patent No.: US 6,637,386 B2
(45) Date of Patent: Oct. 28, 2003

(54) VARIABLE VALVE TIMING APPARATUS

(75) Inventors: Shinichi Murata, Okazaki (JP); Fumiaki Hiraishi, Kyoto (JP); Kazuhiro Okuno, Katou-gun (JP); Hideo Nakai, Kusatsu (JP); Osamu Nakayama, Toyota (JP); Takashi Dogahara, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 6 days.

(21) Appl. No.: 09/989,405

(22) Filed: Nov. 21, 2001

(65) Prior Publication Data

US 2002/0062799 A1 May 30, 2002

(30) Foreign Application Priority Data

Nov. 21, 2000 (JP) ..... 2000-354116
Jan. 12, 2001 (JP) ..... 2001-004983
Jan. 25, 2001 (JP) ..... 2001-017149

(51) Int. Cl.[7] ..... F01L 1/34

(52) U.S. Cl. ..... 123/90.15; 123/90.16; 123/90.31

(58) Field of Search ..... 123/90.11–90.18, 123/90.31; 60/284–285

(56) References Cited

U.S. PATENT DOCUMENTS 5,626,109 A * 5/1997 Yasumura et al. ..... 123/90.15
5,848,529 A * 12/1998 Katoh et al. ..... 60/274
6,250,266 B1 * 6/2001 Okui et al. ..... 123/90.17
6,266,957 B1 7/2001 Nozawa et al. ..... 60/284
6,360,531 B1 * 3/2002 Wiemero et al. ..... 60/284

FOREIGN PATENT DOCUMENTS

JP 11-336574 A 12/1999 ..... F02D/13/02

* cited by examiner

*Primary Examiner*—Thomas Denion
*Assistant Examiner*—Kyle Riddle
(74) *Attorney, Agent, or Firm*—Birch, Stewart, Kolasch & Birch, LLP

(57) ABSTRACT

Just after the start of an engine at cold start, an overlap in the opening time of an intake valve (7*a*) and an exhaust valve (7*b*) is controlled to include an intake stroke range, such that liquid fuel in an intake port (11) flows into a cylinder with the downward movement of a piston (16) without being directly exhausted to an exhaust side, so that the fuel can be combusted without fail.

25 Claims, 14 Drawing Sheets

VARIABLE VALVE TIMING APPARATUS

This nonprovisional application claims priority under 35 U.S.C. §119(a) on Patent Application Nos. 2000-354116, 2001-4983, and 2001-17149, filed in Japan on Nov. 21, 2000, Jan. 12, 2001, and Jan. 25, 2001, respectively, which are herein incorporated by reference.

BACKGROUND OF THE INVENTION

1. Field of the Invention

The present invention generally relates to a variable valve timing apparatus for adjusting opening and closing timing of an intake valve and an exhaust valve in an external combustion engine (hereinafter, referred to as "engine")

2. Description of Related Art

It is known that an overlap in the opening time of an exhaust valve and an intake valve is increased at the cold start of an engine to reduce the emission of unburned HC. For example, Japanese Patent Laid-open Publication No. 11-336574 discloses closing an exhaust valve usually at a top dead center (TDC) of the intake stroke, advancing the exhaust valve to improve the afterburning effect in cold starting, and advancing an intake valve by the maximum amount to increase an overlap to thus increase the internal EGR. The internal EGR is the gas that is exhausted to the intake side when an intake valve opens in an exhaust stroke, and reenters a cylinder in the next intake stroke.

According to the prior art disclosed in the above publication, however, if there is liquid fuel, a part thereof is exhausted without undergoing a combustion stroke since the overlap lies ahead of the TDC, that is, in an exhaust stroke.

If an intake port injection type engine is given as an example, fuel injected into an intake port adheres to the side (back side) of an intake valve away from a combustion chamber and to the intake port just after the cold start of the engine, and is stored in the form of liquid in the vicinity of a lower valve sheet due to the tare weight thereof while an intake valve is opened. If the intake valve is opened in the exhaust stroke (if an overlap lies in the exhaust stroke), the fuel flows directly into a cylinder during the first stroke at clanking (the first opening of the intake valve). Although the exhaust gas in each cylinder flows back into an exhaust pipe after the first stroke, the fuel partially flows into the cylinder due to the tare weight since the fuel is in the form of a liquid.

The fuel is exhausted directly to an exhaust side by the upward movement of a piston, or is evaporated and partially discharged in the form of unburned fuel to an exhaust side. Then, the exhaust valve closes before the TDC to inhibit the unburned fuel, having passed through the cylinder, from returning into the cylinder, or the unburned fuel is discharged directly into the atmosphere without after-burning due to the low temperature of the fuel. If the engine temperature is then increased by repeated combustions, the fuel is atomized due to the heated intake port, as a result of hot exhaust gas blowing into the intake port, to inhibit the liquid fuel from flowing into the cylinder and entering an exhaust passage.

Therefore, in order to reduce the emission of unburned HC at the cold start of the engine, it is necessary to prevent the discharge of liquid fuel, which cannot be atomized just after the cold start, before increasing the internal EGR to facilitate the atomization of the fuel.

SUMMARY OF THE INVENTION

It is therefore an object of the present invention to provide a variable valve timing apparatus capable of properly controlling an overlap in the opening time of an intake valve and an exhaust valve to surely control the emission of unburned HC at the cold start of an engine.

The above object can be accomplished by providing a variable valve timing apparatus that increases an overlap in opening time of an intake valve and an exhaust valve at cold start of an internal combustion engine, wherein the overlap comprises an exhaust stroke range ahead of a top dead center and an intake stroke range after the top dead center; and there is provided a valve timing control means for forming an overlap including the intake stroke range just after the internal combustion engine is started at the cold start, and then increases the overlap in the exhaust stroke range.

Therefore, at the cold start of the engine, the overlap in the opening time of the intake valve and the exhaust valve is controlled to include the intake stroke range just after the cold start and to then increase the exhaust stroke range. At the cold start, when the fuel is not facilitated to atomize, the fuel injected into an intake port is stored in the form of liquid in the vicinity of a valve sheet while the valve is opened, but as a piston moves downward during the overlap in the intake stroke range just after the cold start, the liquid fuel flows into a cylinder without being directly discharged so that the fuel can be combusted without fail. If the overlap in the exhaust stroke range is then increased, exhaust gases or the like having exhausted once to the exhaust side flow back into the intake port to prevent the discharge of the liquid fuel, or to prevent an after-burning effect resulting from the early opening of the exhaust valve raises the temperature of a catalyst.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

There will now be described a variable valve timing apparatus that changes the opening and closing timing of an intake valve according to the first embodiment of the present invention.

Figure 1:
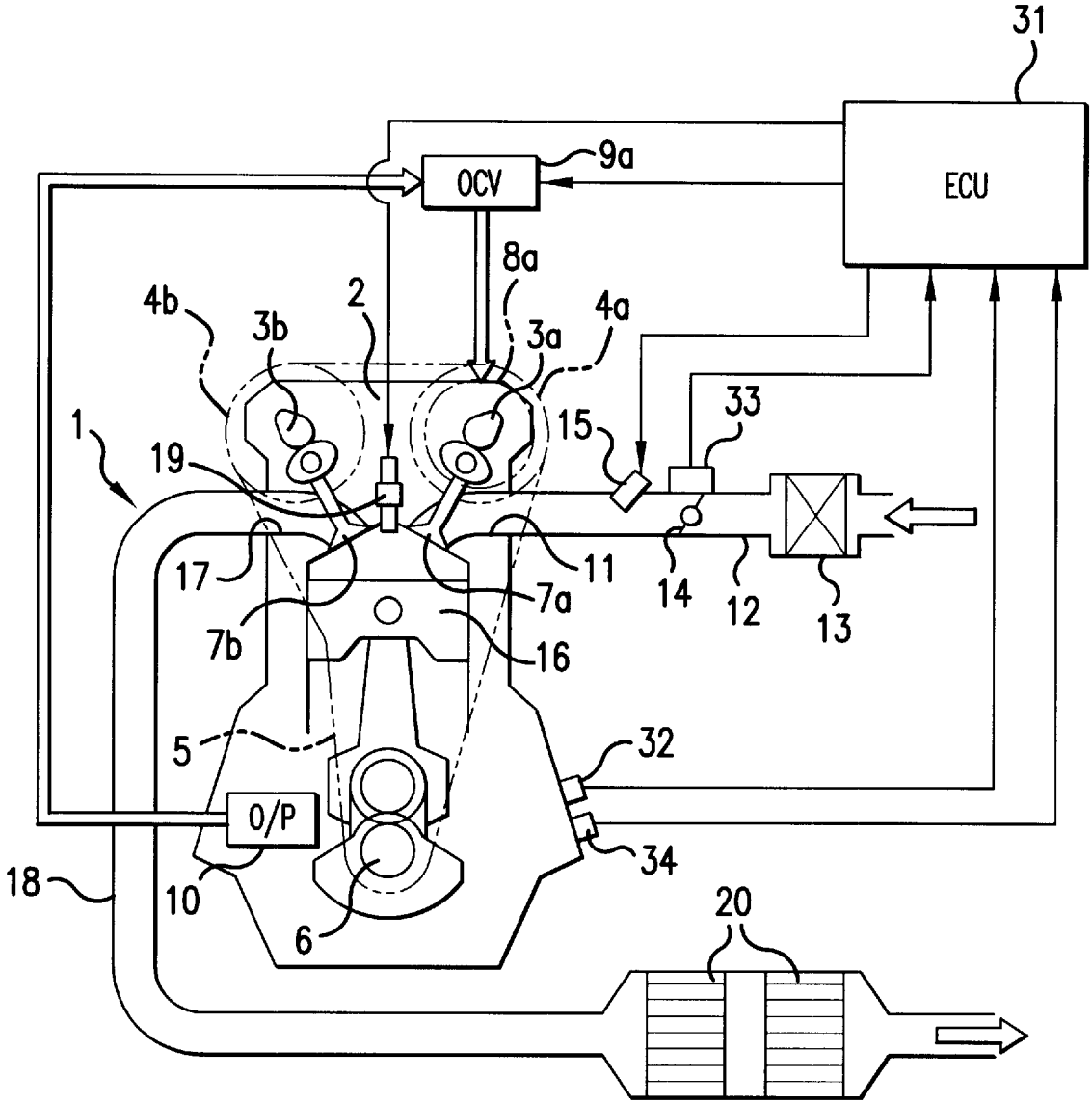
FIG. 1 is a diagram showing the entire arrangement of a variable valve timing apparatus according to the first embodiment.

FIG. 1 is a diagram showing the entire arrangement of a variable valve timing apparatus according to the first embodiment. As shown in FIG. 1, an engine 1 is an intake port injection type engine, and its valve moving mechanism is a DOHC 4 valve system. Timing pulleys 4*a*, 4*b* are connected to the respective front ends of an intake cam shaft 3*a* and an exhaust cam shaft 3*b* on a cylinder head 2, and are connected to a crank shaft 6 through a timing belt 5. The rotation of the crank shaft 6 causes the cam shaft 3*a*, 3*b* to rotate with the timing pulleys 4*a*, 4*b*, and the cam shaft 3*a*, 3*b* cause intake valves 7*a*, 7*b* to open and close.

A vane timing changing mechanism 8*a*, serving as an intake valve timing changing means, is provided between the intake cam shaft 3*a* and the timing pulley 4*a* at the intake side. Although a detailed description of the known arrangement of the timing changing mechanism 8*a* is omitted herein, a vane rotor is rotatably provided in a housing of the timing pulley 4*a*, and the intake cam shaft 3*a* is connected to the vane rotor. An oil control valve (hereinafter, referred to as "OCV") 9*a* is connected to the timing changing mechanism 8*a*, and hydraulic pressure is applied to the vane rotor according to the switching operation of the OCV 9*a* by utilizing hydraulic fluids supplied from an oil pump 10 of the engine 1. This adjusts the phase of the cam shaft 3*a* with respect to the timing pulley 4*a*, that is, the opening and closing timing of the intake valve 7*a*.

On the other hand, an intake passage 12 is connected to an intake port 11 of the cylinder head 2, and the intake air is led from an air cleaner 13 into the intake passage 12, and mixed with fuel injected from a fuel injection valve 15 after the flow rate of the intake air is adjusted according to the angle of the throttle valve 14.

An exhaust passage 18 is connected to an exhaust port 17 of the cylinder head 2. Exhaust gases burned by ignition of an ignition plug 19 is guided from the exhaust port 17 into the exhaust passage 18 as a piston 16 moves upward when the exhaust valve 7*b* is opened, and are then exhausted to the outside via a catalyst 20 and a muffler not illustrated.

To totally control the engine 1, a vehicle compartment contains an input/output device, not shown; a storage device (e.g. a ROM, a RAM, a BURAM), not shown, that stores a control program, a control map, and the like; a central processing unit (CPU), not shown; an ECU (engine control unit) 31 having a timer counter, and the like. A variety of sensors, such as a revolutionary speed sensor 32 that detects the engine speed N, a throttle angle sensor 33 that detects the angle TPS of a throttle valve 14, and a water temperature sensor 34 that detects the cooling water temperature $T_w$, are connected to the input side of the ECU 31. The OCV 9*a*, the fuel injection valve 15, the ignition plug 19, and the like are connected to the output side of the ECU 31.

The ECU 31 determines an ignition timing, a fuel injection volume, and the like according to sensor information outputted from the sensors, and controls operations of the ignition plug 19 and the fuel injection valve 15. The ECU 31 also calculates a target phase angle of the timing changing mechanism 8*a* based upon an engine revolutionary speed Ne and a throttle angle TPS according to a predetermined map, and drives the OCV 9*a* to control the actual phase angle to the target phase angle. Further, to control the emission of unburned HC, the ECU 31 performs a special phase angle control routine that is different from what is performed in the case of a warm start of the engine or the like.

Referring now to a time chart of FIG. 2, there will be described the phase angle control routine performed by the ECU 31 in the case of a cold start of the engine.

Figure 2:
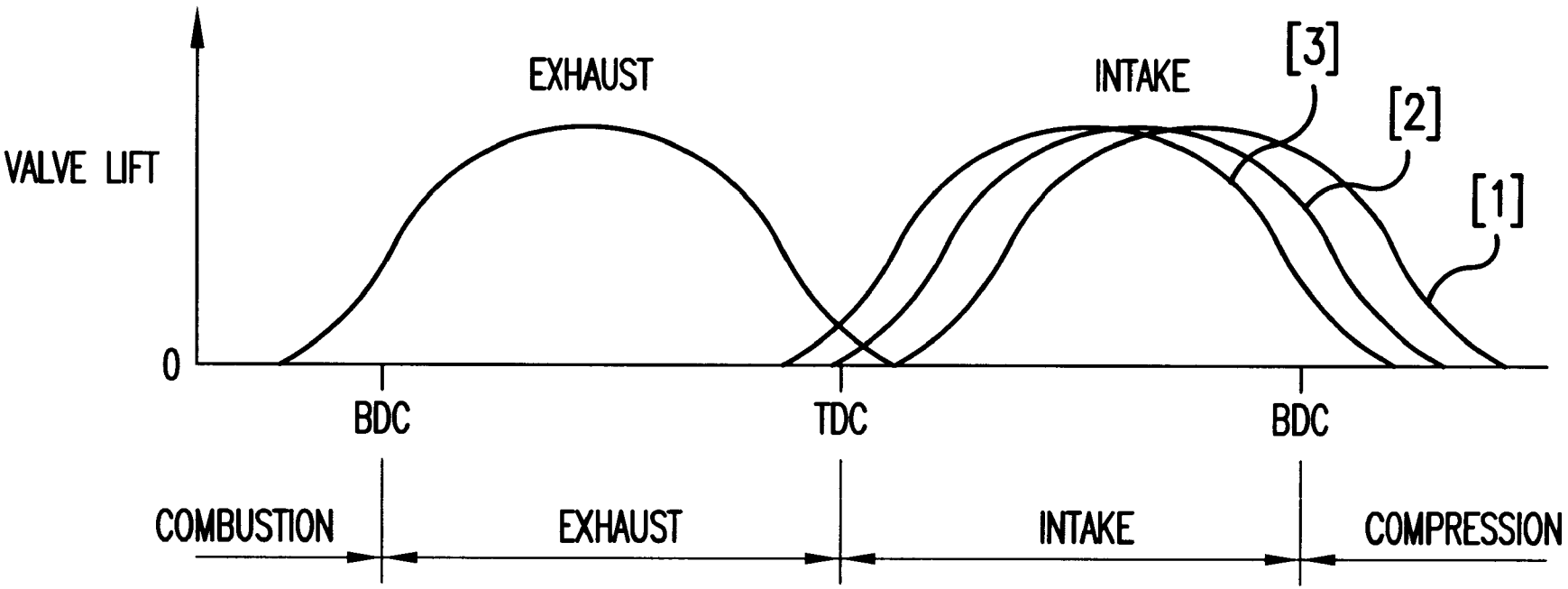
FIG. 2 is a time chart showing the state in which the phase angle is controlled by the variable valve timing apparatus according to the first embodiment.

The opening and closing timing of the intake valve 7*a* is adjusted within the range between [1] and [2] in FIG. 2 by the timing changing mechanism 8*a*, whereas the opening and closing timing of the exhaust valve 7*b* is fixed at a position shown in FIG. 2. First, while the engine is stopped, the opening and closing timing of the intake valve 7*a* is maintained at the maximum retard position indicated by [1] in FIG. 2, so that the intake valve 7*a* can start opening at or after a TDC of intake stroke. The opening timing of the intake valve 7*a* substantially corresponds to the closing timing of the exhaust valve 7*b*, and thus, an overlap in the opening timing of the intake valve 7*a* and the exhaust valve 7*b* is approximately zero.

When a driver turns on an ignition switch, the engine 1 is caused to be cranked at this phase angle and the ECU 31 controls the ignition timing and the fuel injection. Since the overlap in the opening time of the intake and exhaust valves during the cranking process is zero, the injected fuel is combusted without passing through the cylinder to the exhaust side and the engine 1 can easily be cranked to perform a first combustion.

The above described operations in the phase angle control routine are common to the warm start and the cold start. If the ECU 31 determines that the engine is warm started based on a cooling water temperature $T_w$ or the like, the opening and closing timing of the intake valve 7*a* is maintained at the maximum retard position insofar as the engine continues idling after the completion of the start. If the engine speed Ne and the throttle angle TPS are increased due to the start of the vehicle, the opening and closing timing of the intake valve 7*a* is advanced.

On the other hand, at the cold start of the engine, the opening and closing timing of the intake valve 7*a* is advanced up to a position indicated by [2] in FIG. 2 when about two seconds have elapsed since the first combustion. The advance of the opening and closing timing causes the intake valve 7*a* to start opening far ahead of the TDC. This forms an overlap in the opening time of the intake valve 7*a* and the exhaust valve 7*b*, and most of the overlap lies after the TDC (hereinafter, referred to as "intake stroke range").

Since the atomization of the fuel injected to the intake port 11 is not facilitated at the cold start of the engine, the fuel adheres to the back side of the intake valve 7*a* and to the inner wall of the intake port 11, and is stored in the form of liquid in the vicinity of a lower valve sheet due to the tare weight while the valve is closed. This tendency becomes even more striking if the fuel is increased in order to ensure ignition. If the intake valve 7*a* opens in the intake stroke range as mentioned above, the fuel in the form of liquid flows into a cylinder with the downward movement of the piston 16 and is exhausted to the exhaust side in an exhaust stroke after it is combusted in a combustion stroke via a compression stroke. More specifically, the liquid fuel flowing into the cylinder is prevented from being directly exhausted to the exhaust side as is the case with the prior art in which the overlap lies in the exhaust stroke.

Since the exhaust valve 7*a* is opened far ahead of the TDC, a short overlap is formed before the TDC (hereinafter, referred to as "exhaust stroke range"). Even if the liquid fuel passes through the cylinder to the exhaust side during this overlap, the fuel is returned into the cylinder in the subsequent intake stroke range so that the fuel can be atomized and combusted without fail. Although the fuel cannot be stably combusted on this occasion due to the low engine temperature, only a small amount of exhaust gases flows back into the cylinder after it is once exhausted to the exhaust side, since it is difficult to generate the internal EGR due to the relatively short overlap. This makes it easier to maintain and increase the revolution speed after the start.

The above mentioned phase is maintained for a predetermined period of time since the first combustion, and the opening and closing timing of the intake valve 7*a* is then advanced and maintained at the full advance position indicated by [3] in FIG. 2. Therefore, the overlap in the opening time of the intake valve 7*a* and the exhaust valve 7*b* is significantly increased to be advanced to completely include the exhaust stroke range.

On this occasion, the closing timing of the exhaust valve 7*b* lies at or after the TDC, and at this point in time after several strokes from the first combustion, the internal EGR increases to cause the exhaust gases having been exhausted once to the exhaust side (exhaust gases including much unburned HC exhausted at the end of the exhaust stroke) to flow back into the exhaust port 11 due to the generation of sufficient negative pressure in the intake port 11 with the rise in the engine speed Ne. The exhaust gases are then combusted in the next combustion stroke, and the temperature of the exhaust port 11 is increased due to the heat received from the exhaust gases to thus facilitate the atomization of fuel injected next. This surely prevents the liquid fuel from being discharged to the exhaust side.

Thereafter, if a predetermined period of time has elapsed, the opening and closing timing of the intake valve 7*a* is retarded to return to the starting state indicated by [1] in FIG. 2. As a result, the overlap in the opening time of the intake valve 7*a* and the exhaust valve 7*b* is reduced, and the decrease in the internal EGR stabilizes the combustion to realize smooth idling.

In the above described variable valve timing apparatus according to the first embodiment, the overlap in the opening time of the intake valve 7*a* and the exhaust valve 7*b* is formed in the intake stroke range ([2] in FIG. 2), and the liquid fuel in the intake port 7*a* flows into the cylinder with the downward movement of the piston 16 so that it can be combusted without fail. This prevents the liquid fuel from being discharged directly to the exhaust side. Therefore, the variable valve timing apparatus according to the first embodiment prevents the liquid fuel having flowed into the cylinder from being discharged directly to the exhaust side, and thus surely controls the emission of unburned HC at the cold start of the engine.

Although in the first embodiment, the opening and closing timing of the intake valve 7*a* is changed in order of [1], [2], and [3], the opening and closing timing of the intake valve 7*a* may be maintained at the position indicated by [2] at the beginning of the start of the engine and then sequentially changed in order of [2], [2], and [3]. In this case, as described above, the liquid fuel in the intake port 7*a* can be combusted without fail and the emission of unburned HC can be controlled.

Second Embodiment

There will now be described a variable valve timing apparatus according to the second embodiment of the present invention.

The variable valve timing apparatus according to the second embodiment is capable of changing the opening and closing timing of the exhaust valve 7*b* as well as the intake valve 7*a*. The other arrangement of the variable valve timing apparatus according to the second embodiment is similar to that of the variable valve timing apparatus according to the first embodiment. A description of common parts is therefore omitted herein, and only differences will be now described in detail.

Figure 3:
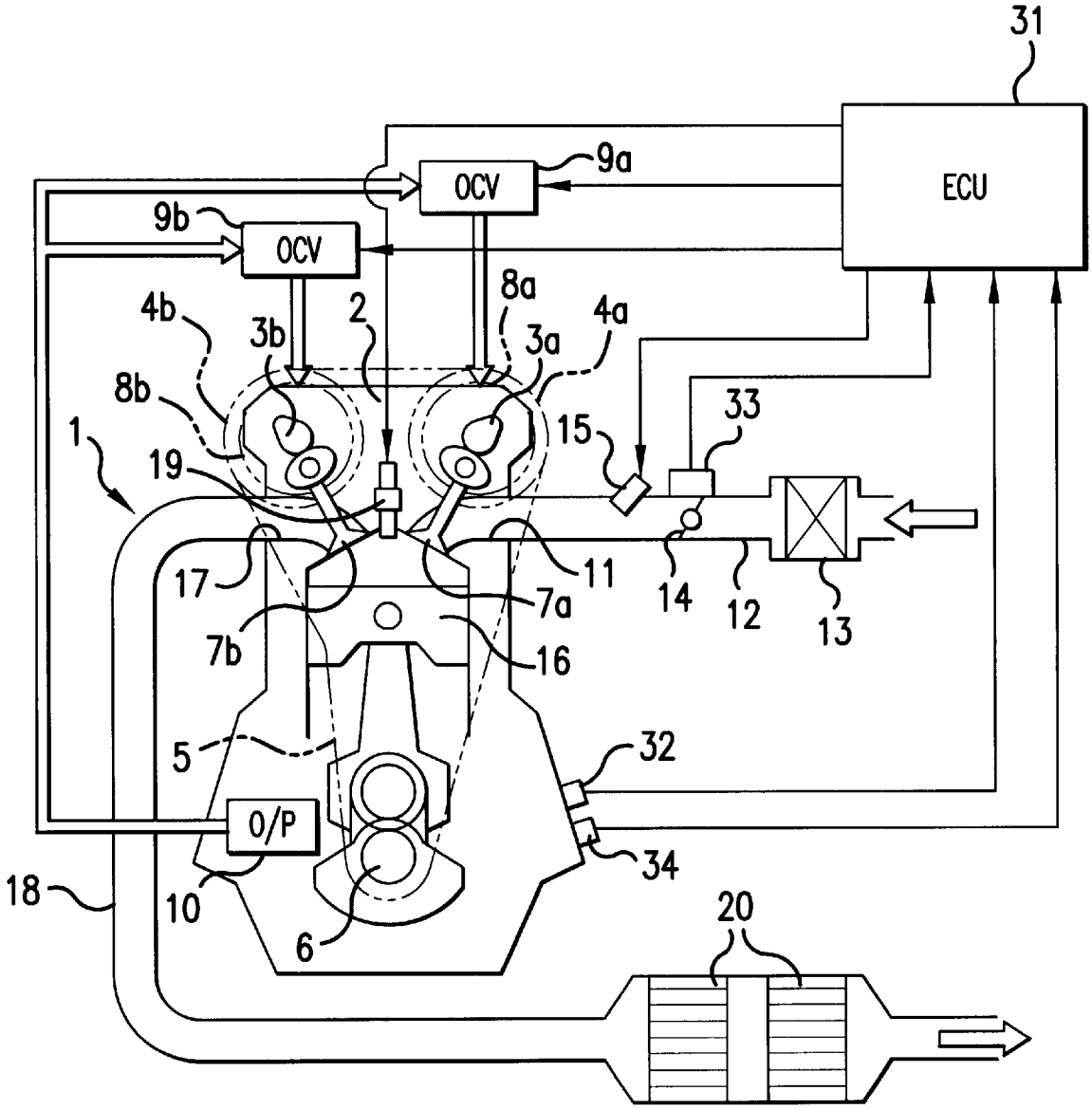
FIG. 3 is a diagram showing the entire arrangement of a variable valve timing apparatus according to the second embodiment.

As shown in FIG. 3, a timing changing mechanism 8*b*, serving as an exhaust valve timing changing means similar to the one at the intake side, is provided between the exhaust cam shaft 3*b* and the timing pulley 4*b* at the exhaust side. The timing changing mechanism 8*b* is connected to the ECU 31 through an OCV 9*b*. At the cold start of the engine, the phase angle of the timing changing mechanism 8*b*, as well as the timing changing mechanism 8*a*, is controlled by the ECU 31, and this will now be described with reference to a time chart of FIG. 4.

Figure 4:
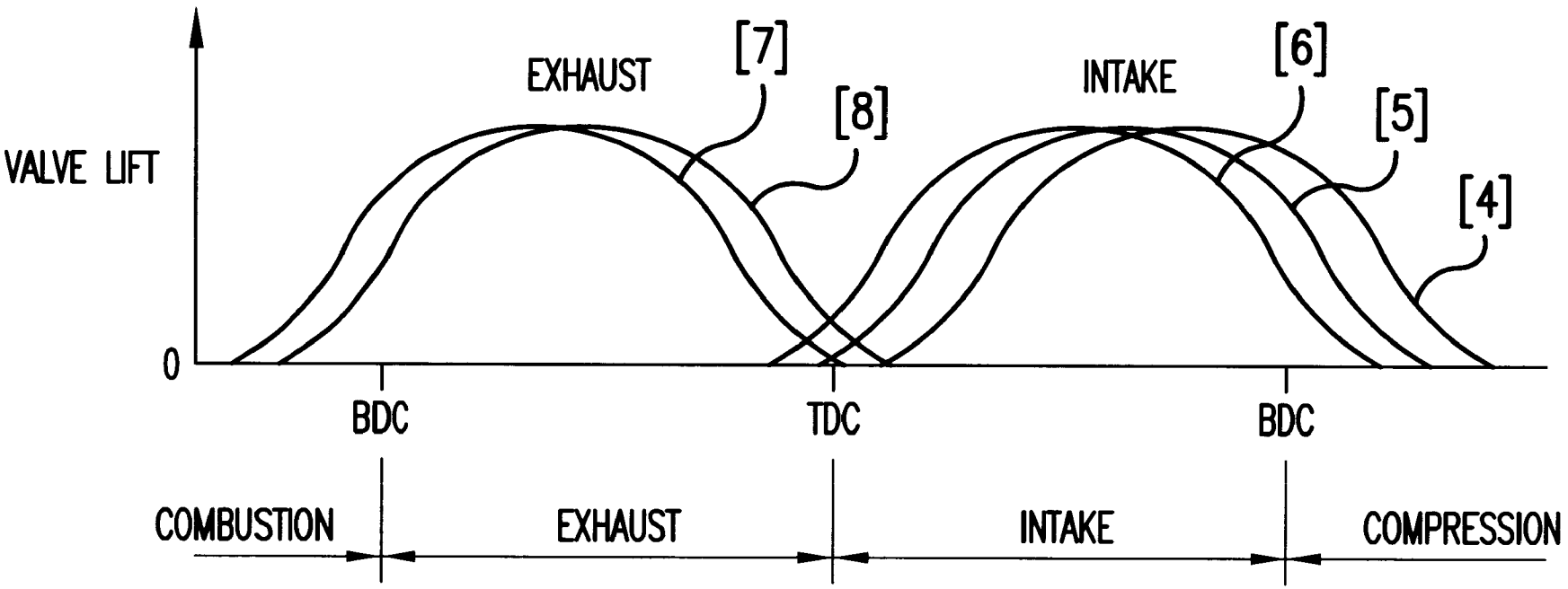
FIG. 4 is a time chart showing the state in which the phase angle is controlled by the variable valve timing apparatus according to the second embodiment.

While the engine is stopped, the opening and closing timing of the intake valve 7*a* is maintained at the maximum retard position indicated by [4] in FIG. 4 whereas the opening and closing timing of the exhaust valve 7*b* is maintained at the maximum advance position indicated by [7] in FIG. 4. Therefore, an overlap in the opening time of both valves is exactly zero.

When about two seconds have elapsed since the engine starts cranking at this phase position, the opening and closing timing of the intake valve 7*a* is advanced as indicated by [5] in FIG. 4 and the opening and closing timing of the exhaust valve 7*b* is retarded as indicated by [8] in FIG. 4. This forms an overlap in the opening timing of the intake valve 7*a* and the exhaust valve 7*b*, and most of the overlap lies in the intake stroke range as is the case with the first embodiment ([2] in FIG. 2). Thus, the liquid fuel in the intake port 11 flows into the cylinder with the downward movement of the piston 16 so that it can be combusted without fail. This prevents the fuel from being discharged into the atmosphere in the form of liquid.

When a predetermined period of time has elapsed since the first combustion, the opening and closing timing of the intake valve 7*a* is further advanced as indicated by [6] in FIG. 4 and the opening and closing timing of the exhaust valve 7*b* is advanced to a position indicated by [7] in FIG.

4. Therefore, most of the overlap in the opening time of the intake valve 7*a* and the exhaust valve 7*b* lies in the exhaust stroke range, and the early opening of the exhaust valve 7*b* discharges the exhaust gases at a temperature in proximity to the peak cylinder temperature, and the after-burning effect realizes the early activation of the catalyst 20.

As described above, the variable valve timing apparatus according to the second embodiment forms the overlap in the opening time of the intake valve 7*a* and the exhaust valve 7*b* in the intake stroke range ([4] and [8] in FIG. 4) just after the start of the cold start as is the case with the first embodiment, so that the liquid fuel in the intake port 11 can be combusted without fail and the emission of unburned NC can be surely controlled.

Further, according to the second embodiment, the length and position of the overlap can be freely determined since it is possible to change the opening and closing timing of the exhaust valve 7*b* as well as the intake valve 7*a*. Therefore, for example, the overlap can shift from the intake stroke range to the exhaust stroke range (from [5], [6] to [7], [8] in FIG. 4) without increasing an amount of overlap according to the second embodiment, although the amount of overlap is necessarily increased with the advance in the opening and closing timing of the intake valve 7*a* (from [2] to [3] in FIG. 2) according to the first embodiment. This achieves the optimum amount of overlap, i.e. the optimum amount of internal EGR for every operating state to thereby enable the stable combustion.

Although in the second embodiment, the opening and closing timing of the intake valve 7*a* is changed in order of [4], [5], and [6] in FIG. 4 and the opening and closing timing of the exhaust valve 7*b* is changed in order of [7], [8], and [7] according to the steps of the start, the opening and closing timing of the intake valve 7*a* and the exhaust valve 7*b* may be controlled in another order. For example, the opening and closing timing of the intake valve 7*a* may be changed in order of [5], [5], and [6] as is the case with the first embodiment, and the opening and closing timing of the exhaust valve 7*b* may be changed in order of [8], [8], and [7], or in order of [7], [8], and [8].

Third Embodiment

There will now be described a variable valve timing apparatus according to the third embodiment of the present invention.

The arrangement of the variable valve timing apparatus according to the third embodiment is identical to that of the variable valve timing apparatus according to the second embodiment except for the opening and closing timing of the intake valve 7*a* and the exhaust valve 7*b*. A description of common parts is therefore omitted herein, and only a difference, i.e. how to control the phase angle of the intake valve 7*a* and the exhaust valve 7*b* will now be described in detail.

Figure 5:
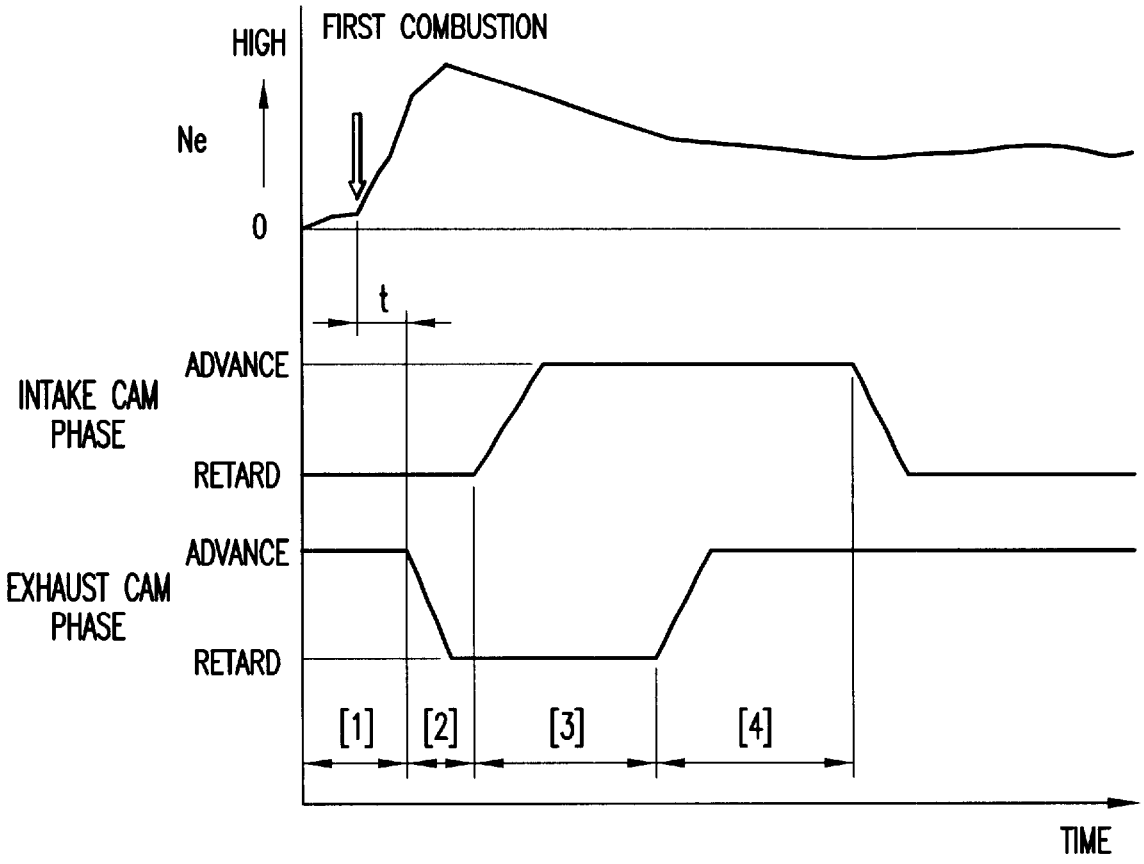
FIG. 5 is a time chart showing the state in which the phase angle of a cam shaft is controlled by a variable valve timing apparatus according to the third embodiment.
Figure 6:
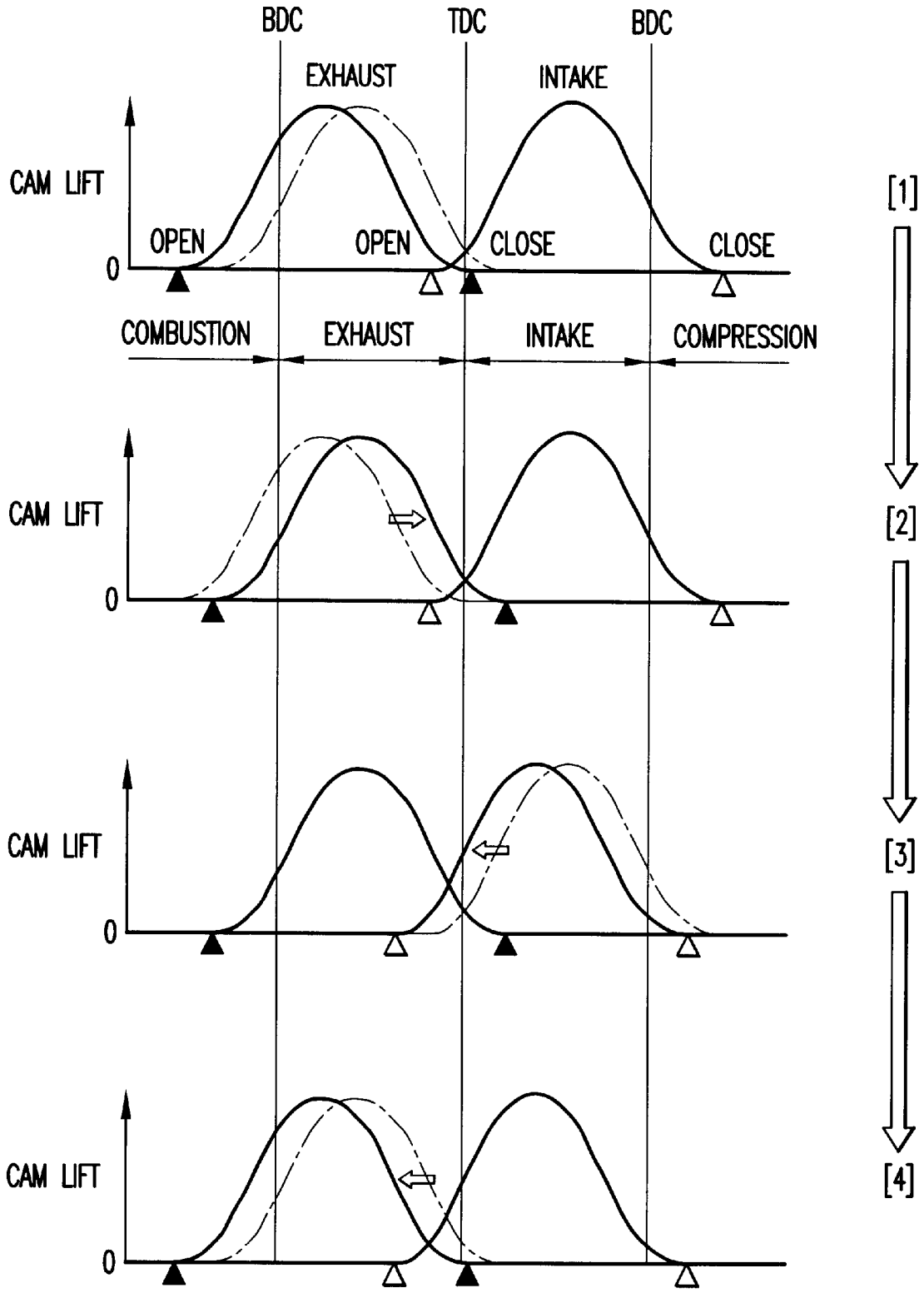
FIG. 6 is an explanatory drawing sequentially showing the changes in the phase angle of the cam shaft according to the third embodiment.

FIG. 5 is a time chart showing the state in which the phase angle of a cam shaft is controlled by the variable valve timing apparatus according to the third embodiment, and FIG. 6 is an explanatory drawing sequentially showing the changes in the phase angle of the cam shaft according to the third embodiment.

While the engine is stopped, the phase of the intake cam shaft 3*a* is maintained at a retard position indicated by [1] in FIGS. 5 and 6, whereas the phase of the exhaust cam shaft 3*b* is maintained at an advance position. Therefore, an overlap in the opening time of both valves is approximately zero. When the driver turns on the ignition switch, the engine 1 is cranked at this phase angle and the ECU 31 controls the ignition timing and the fuel injection. On this occasion, the atomization of fuel is not facilitated since the temperature of the intake port 11 is equivalent to the outside temperature, and most of an increased amount of injected fuel is stored in the form of liquid in the intake port 11 while the intake valve 7*a* is closed, and flows into the cylinder when the intake valve 7*a* is opened. Since the overlap in the opening time of the intake and exhaust valves during the cranking process is approximately zero as mentioned above, the fuel that flowed into the cylinder is combusted without passing through the cylinder to the exhaust side. This enables the first combustion without emitting a large amount of unburned HC.

If a predetermined period of time t (e.g. two seconds to three seconds) has elapsed since the first combustion, the phase of the exhaust cam shaft 3*b* is retarded as indicated by [2] in FIGS. 5 and 6. Therefore, the closing timing of the exhaust valve 7*b* lies at or after the TDC, and the exhaust gases having passed through the cylinder to the exhaust side are returned into the cylinder with the downward movement of the piston 16 and are combusted in a next combustion stroke. Since the exhaust gases are exhausted at the end of the exhaust stroke and include a large amount of unburned HC in particular, a large amount of unburned HC is combusted in the next combustion stroke so that the exhaust gases can be prevented from being directly discharged to the exhaust side. In addition, since the opening timing of the exhaust valve 7*b* is also retarded, the exhaust gases are combusted for a long period of time to facilitate the oxidization of the unburned HC and raise the temperature of the exhaust gases in the cylinder.

Further, since the overlap is increased with the retard of the exhaust cam shaft 3*b*, the exhaust gases of high temperature flow back as internal EGR to the intake side to thus facilitate evaporation of the fuel in the intake port 11 and raise the temperature of the intake port 11 itself. On this occasion, the negative pressure at the intake side is increased due to the rapid increase in the engine speed Ne with the first combustion, and therefore, the exhaust gases flow back rapidly to overblow and atomize the liquid fuel stored in the intake port 11.

In a timing slightly later than the retard of the exhaust cam shaft 3*b*, the phase of the intake cam shaft 3*a* is advanced as indicated by [3] in FIGS. 5 and 6 to further increase the overlap in the opening time of the intake valve 7*a* and the exhaust valve 7*b*. On this occasion, the fuel is easily evaporated with the rise in the exhaust gas temperature than in the first combustion, and the early opening of the intake valve 7*a* raises the compression temperature and the cylinder temperature. Moreover, due to the atomization of the liquid fuel by the internal EGR as described above, the stable combustion continues even if the internal EGR is increased due to the increase in the overlap.

Thereafter, when a predetermined period of time has elapsed, the phase of the exhaust cam shaft 3*b* is advanced as indicated by [4] in FIG. 4. On this occasion, the temperature of the exhaust passage 18 and the like is higher than at the time point [3], and therefore, if the exhaust gases being combusted are discharged due to the retard of the exhaust valve 7*b*, the after-burning effect continuously combusts the exhaust gases in the exhaust passage 18 and quickly activates the catalyst 20. Although the retard of the exhaust valve 7*b* reduces the overlap, the exhaust gases can be satisfactorily returned into the cylinder to control the emission of unburned HC as described above since the negative pressure is increased at the intake side.

Thereafter, when a predetermined period of time has elapsed, the phase of the intake cam shaft 3*a* is retarded to reduce the overlap in the opening time of the intake valve 7*a* and the exhaust valve 7*b* to thus enable the stable combustion. At the same time, the air to fuel ratio is controlled to be lean to inhibit generation of unburned NC from the fuel combustion residue, and the ignition timing is retarded to compensate for a heating value decreased by the lean operation and to raise the exhaust temperature.

As described above, the variable valve timing apparatus according to the present embodiment increases the overlap ([2], [3] in FIG. 6) by retarding the opening and closing timing of the exhaust valve 7*b* and advancing the opening and closing timing of the intake valve 7*a* at the beginning of cold start when the after-burning effect cannot be expected since the temperature of the exhaust passage 18 cannot be sufficiently raised. Therefore, the exhaust gases having passed through the cylinder to the exhaust side are returned into the cylinder for combustion to thereby control the emission of unburned HC, and the exhaust gases flows back to the intake side to facilitate the evaporation of the fuel and raise the temperature of the intake port 11. If the temperature of the exhaust passage 18, etc. is then raised ([4] in FIG. 6), the opening and closing timing of the exhaust valve 7*b* is advanced to discharge the exhaust gases being combusted, and the after-burning in the exhaust gases 18 quickly activates the catalyst 20.

More specifically, the opening and closing timing of the intake valve 7*a* and the exhaust valve 7*b* is constantly controlled to be optimum according to the rise in the temperature of the engine 1 (the rise in the temperature of the exhaust passage 18, etc.) at the cold start, and this surely controls the emission of unburned HC.

Although the oil pump 10 of the engine 1 cannot supply a sufficient amount of hydraulic fluids if the engine speed Ne is low as in the start of the engine 1, a limited amount of hydraulic fluids is constantly supplied intensively to the timing changing mechanism 8*a* or 8*b* to thus surely control the phase angle.

Fourth Embodiment

There will now be described a variable valve timing apparatus according to the fourth embodiment of the present invention.

The arrangement of the variable valve timing apparatus according to the fourth embodiment is identical to that of the variable valve timing apparatus according to the second embodiment. The fourth embodiment is different from the second and third embodiments only in the opening and closing timing of the intake valve 7*a* and the exhaust valve 7*b*. A description of common parts is therefore omitted herein, and only a difference, i.e. how to control the phase angle of the intake valve 7*a* and the exhaust valve 7*b* will now be described in detail.

Figure 7:
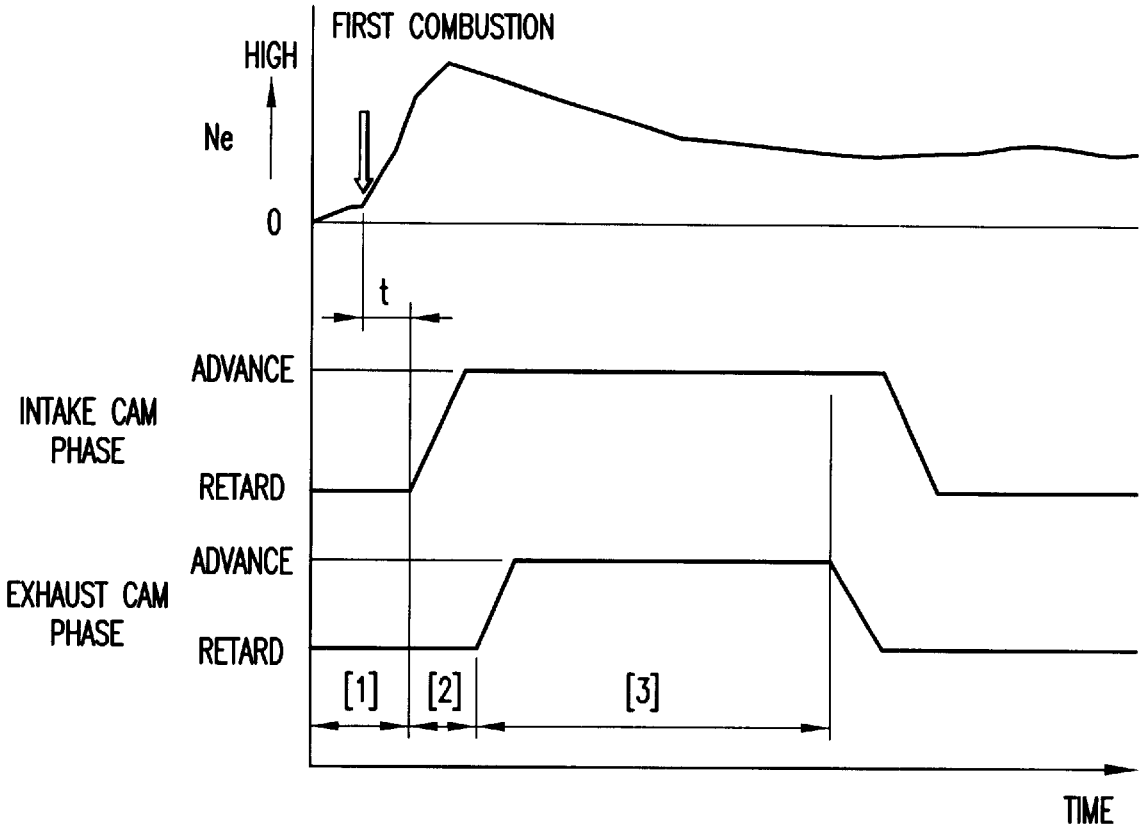
FIG. 7 is a time chart showing the state in which the phase angle of a cam shaft is controlled by a variable valve timing apparatus according to the fourth embodiment.
Figure 8:
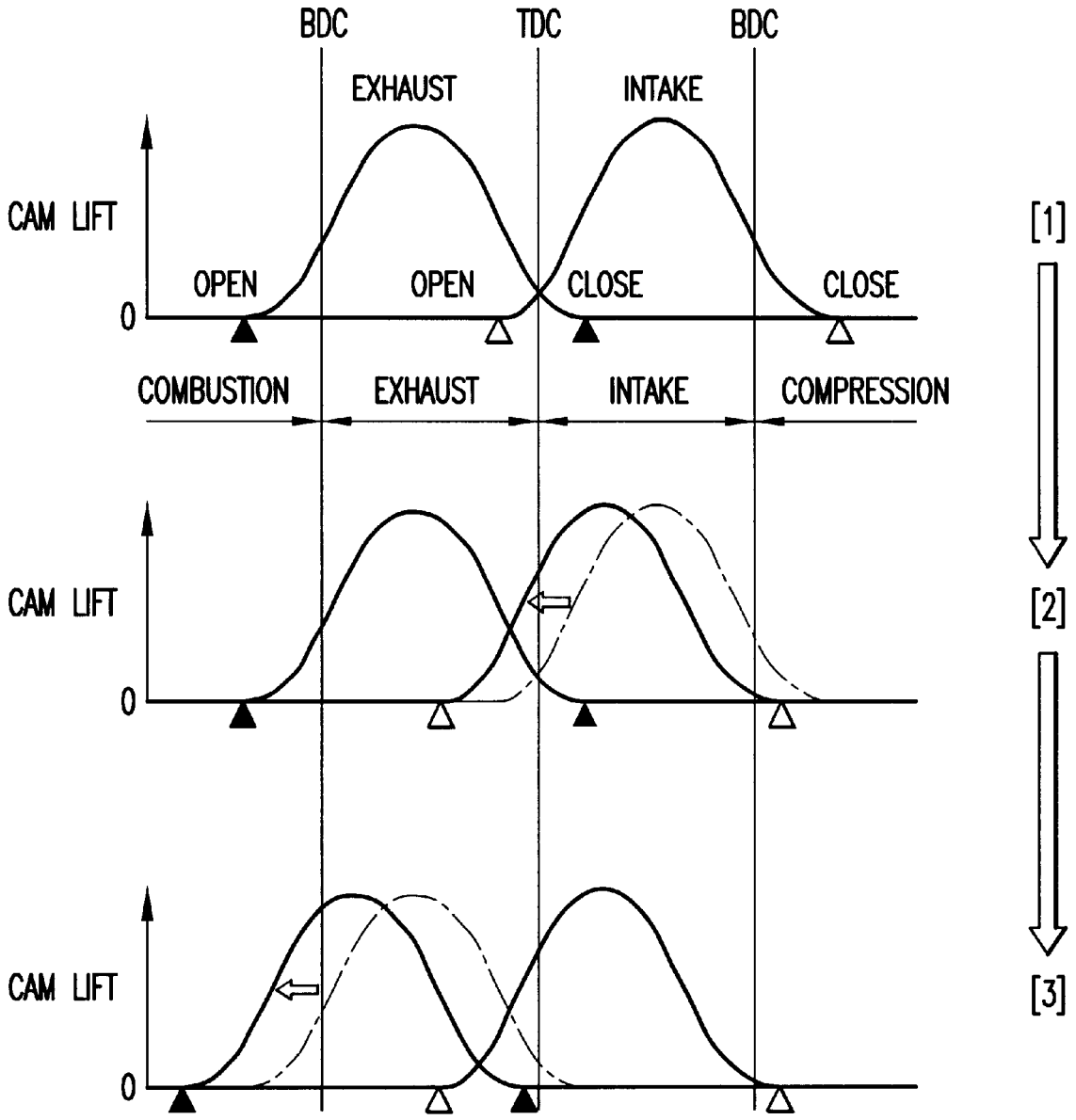
FIG. 8 is an explanatory drawing sequentially showing the changes in the phase angle of the cam shaft according to the fourth embodiment.

FIG. 7 is a time chart showing the state in which the phase angle of a cam shaft is controlled when the engine is cold started, and FIG. 8 is an explanatory drawing sequentially showing the changes in the phase angle of the cam shaft at the cold start of the engine.

While the engine is stopped, the phases of the intake cam shaft 3*a* and the exhaust cam shaft 3*b* are maintained at a retard position indicated by [1] in FIGS. 7 and 8 to form an overlap including the intake stroke and the exhaust stroke. When the engine is started at this phase position, the exhaust gases having passed through the cylinder to the exhaust side are returned into the cylinder due to the downward movement of the piston 16 and are combusted in the next combustion stroke. This enables the first combustion without emitting a large amount of unburned HC. It should be noted that the overlap may include only the intake stroke, and this surely prevents the exhaust side from passing through the cylinder to the exhaust side.

At the cold start of the engine, when a predetermined period of time t (e.g. two seconds to three seconds) has elapsed since the first combustion, the phase of the intake cam shaft 3*a* is advanced as indicated by [2] in FIGS. 7 and 8. Therefore, the exhaust gases having passed through the cylinder to the exhaust side are returned into the cylinder to control the emission of unburned HC, and the internal EGR flowing back to the intake side is increased due to the increase in the overlap to facilitate the evaporation of the fuel in the intake port 11 and raise the temperature of the intake port 11 itself.

Thereafter, when a predetermined period of time has elapsed, the phase of the exhaust cam shaft 3*b* is advanced as indicated by [3] in FIGS. 7 and 8. On this occasion, the exhaust gases being combusted are discharged due to the advance in the opening and closing timing of the exhaust valve 7*b*, and the after-burning effect continuously combusts the exhaust gases in the exhaust passage 18 to activate the catalyst 20.

Thereafter, when a predetermined period of time has elapsed, the phase of the exhaust cam shaft 3*b* is retarded, and the phase of the intake cam shaft 3*a* is retarded. At the same time, the air to fuel ratio is controlled to be lean, and the ignition timing is retarded.

As described above, the variable valve timing apparatus according to the fourth embodiment forms the overlap ([1] in FIG. 8) including the intake stroke range and increases the overlap by advancing the opening and closing timing of the intake valve 7*a* ([2] in FIG. 8) at the cold start when the after-burning effect cannot be expected. Therefore, the exhaust gases are returned into the cylinder for combustion to thereby control the emission of unburned HC, and the exhaust gases flow back to the intake side to facilitate the evaporation of the fuel and raise the temperature of the intake port 11. If the exhaust passage 18 or the like are then muffled ([3] in FIG. 8), the exhaust valve 7*b* is advanced to quickly activate the catalyst 20 by the after-burning effect. Therefore, the opening and closing timing of the intake valve 7*a* and the exhaust valve 7*b* can be constantly controlled to be optimum according to the rise in the temperature of the engine 1 during the cold starting, and this surely controls the emission of unburned HC.

Moreover, the phases of the intake cam shaft 3*a* and the exhaust cam shaft 3*b* are changed one after another, and this enables a limited amount of hydraulic fluids to be constantly supplied intensively to the timing changing mechanism 8*a* or 8*b* to thus surely control the phase angle.

Fifth Embodiment

There will now be described a variable valve timing apparatus according to the fifth embodiment of the present invention.

The arrangement of the variable valve timing apparatus according to the fifth embodiment is identical to that of the variable valve timing apparatus according to the first embodiment except that an intake temperature sensor 35 and an oil temperature sensor 36 are additionally provided and the opening and closing timing of the intake valve 3*a* is different. A description of common parts is therefore omitted herein, and only the differences will now be described in detail.

Figure 9:
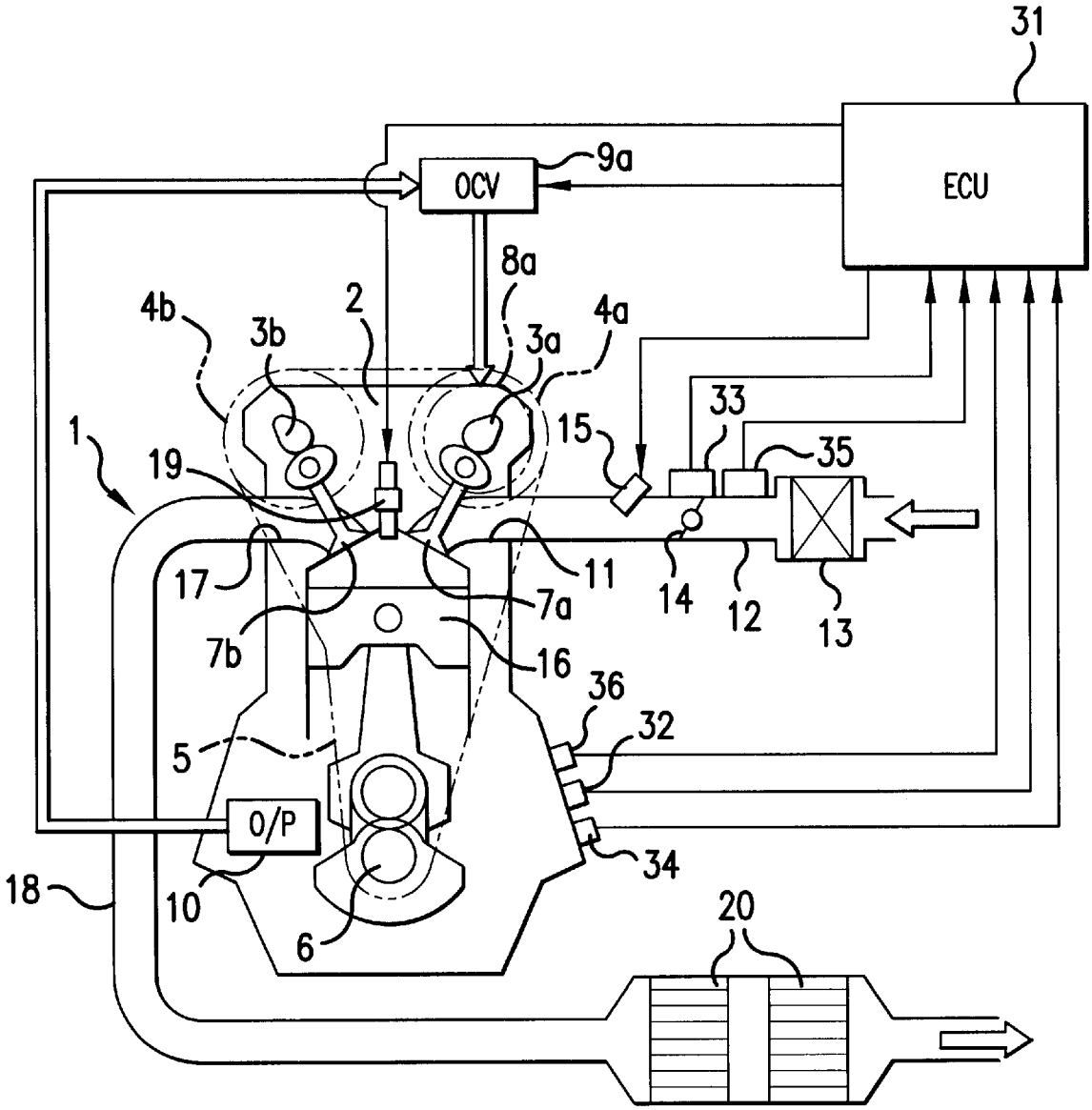
FIG. 9 is a diagram showing the entire arrangement of a variable valve timing apparatus according to the fifth embodiment.

As shown in FIG. 9, with the entire arrangement of the according to the fifth embodiment is identical to that of the variable valve timing apparatus according to the first embodiment shown in FIG. 1, the intake temperature sensor 35 for detecting the intake temperature TA and the oil temperature sensor 36 for detecting the oil temperature TO are connected to the input side of the ECU 31 serving as control delay means, and the revolutionary speed sensor 32, the water temperature sensor 34, the intake temperature sensor 35, and the oil temperature sensor 36 constitute an operating state detecting means.

Figure 10:
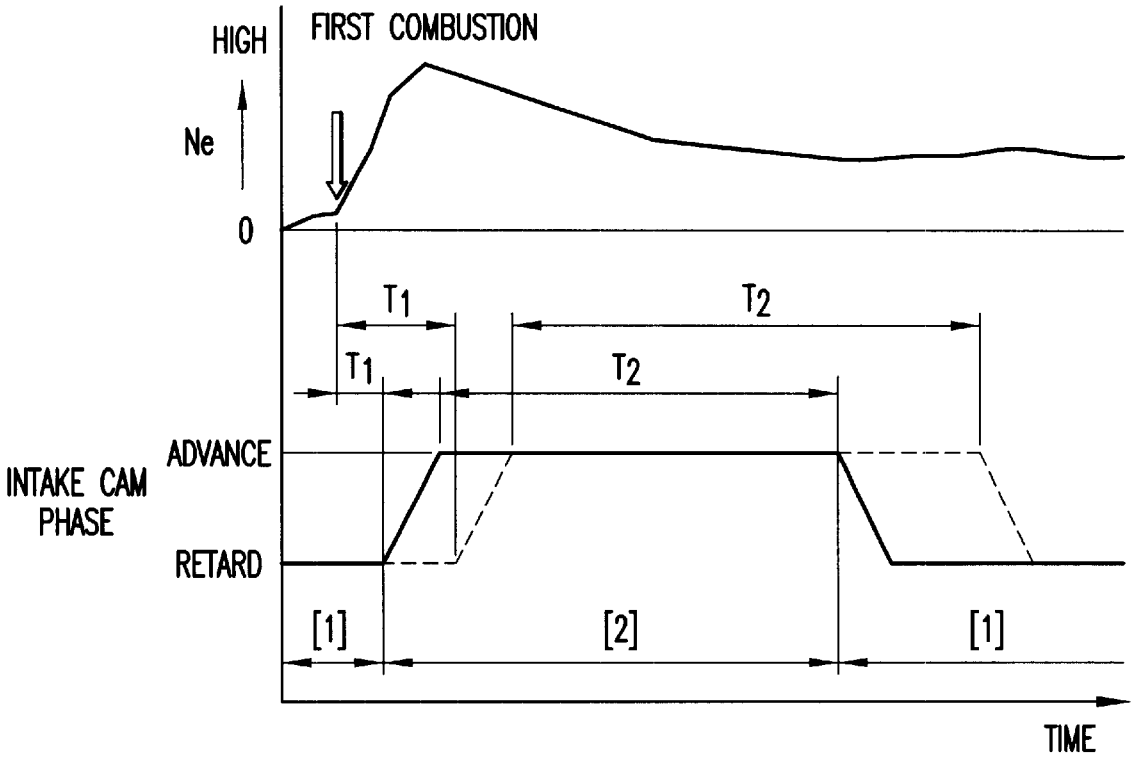
FIG. 10 is a time chart showing the state in which the phase angle is controlled by the variable valve timing apparatus according to the fifth embodiment.
Figure 11:
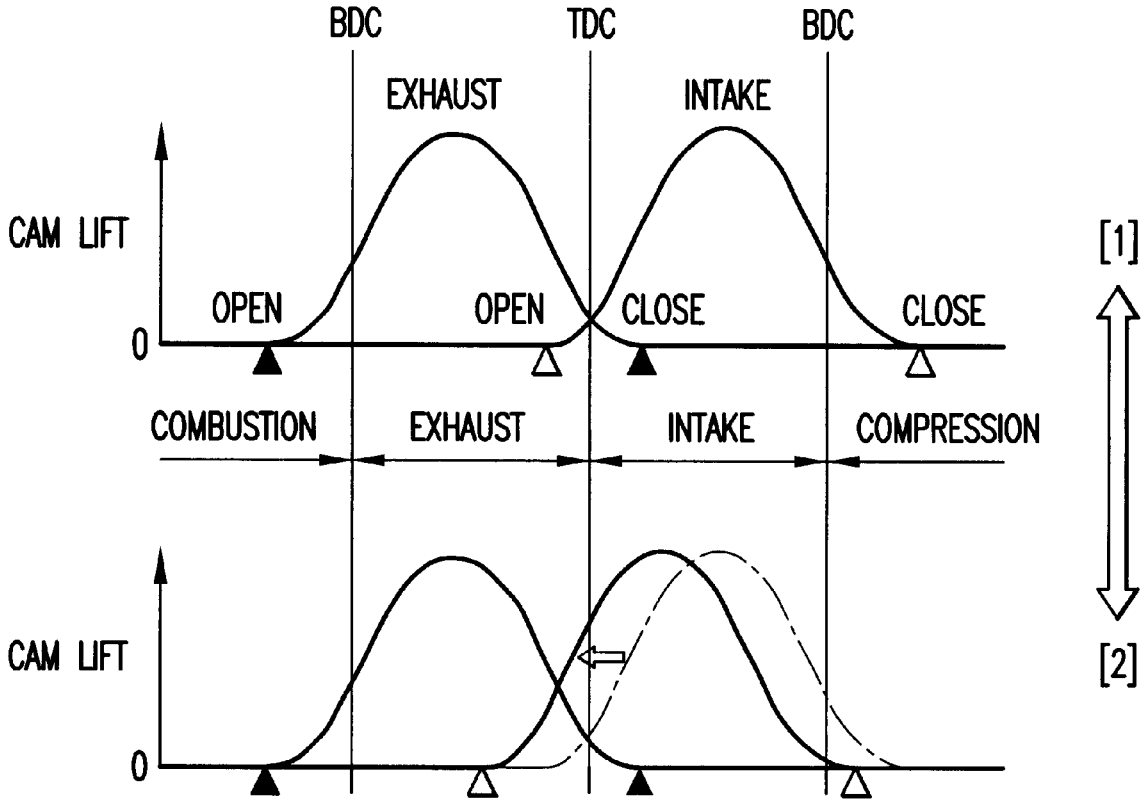
FIG. 11 is an explanatory drawing sequentially showing the changes in the phase angle of the cam shaft according to the fifth embodiment.

There will now be described a phase angle controlling operation performed by the ECU 31 at the cold start. FIG. 10 is a time chart showing the state in which the phase angle of the cam shaft is controlled at the cold start of the engine; FIG. 11 is an explanatory drawing sequentially showing the changes in the phase angle of the cam shaft according to the fifth embodiment; and FIG. 12 is a flow chart showing a phase angle control routine performed by the ECU 31 according to the fifth embodiment at the cold start of the engine.

While the engine is stopped, the phase of the intake cam shaft 3*a* is maintained at a retard position indicated by [1] in FIGS. 10 and 11 to form a relatively short overlap including the intake stroke and the exhaust stroke. When the driver turns on the ignition switch, the engine 1 is caused to be cranked at this phase angle and the ECU 31 controls the ignition timing and the fuel injection. On this occasion, the atomization of fuel is not facilitated since the temperature of the intake port 11 is equivalent to the outside temperature, and a part of the fuel flows directly into the cylinder. However, since the exhaust valve 7*b* is closed at or after the TDC, the exhaust gases having passed through the cylinder to the exhaust side are returned into the cylinder due to the downward movement of the piston 16 and are combusted in the next combustion stroke. This enables the first combustion without emitting a large amount of unburned HC.

Figure 12:
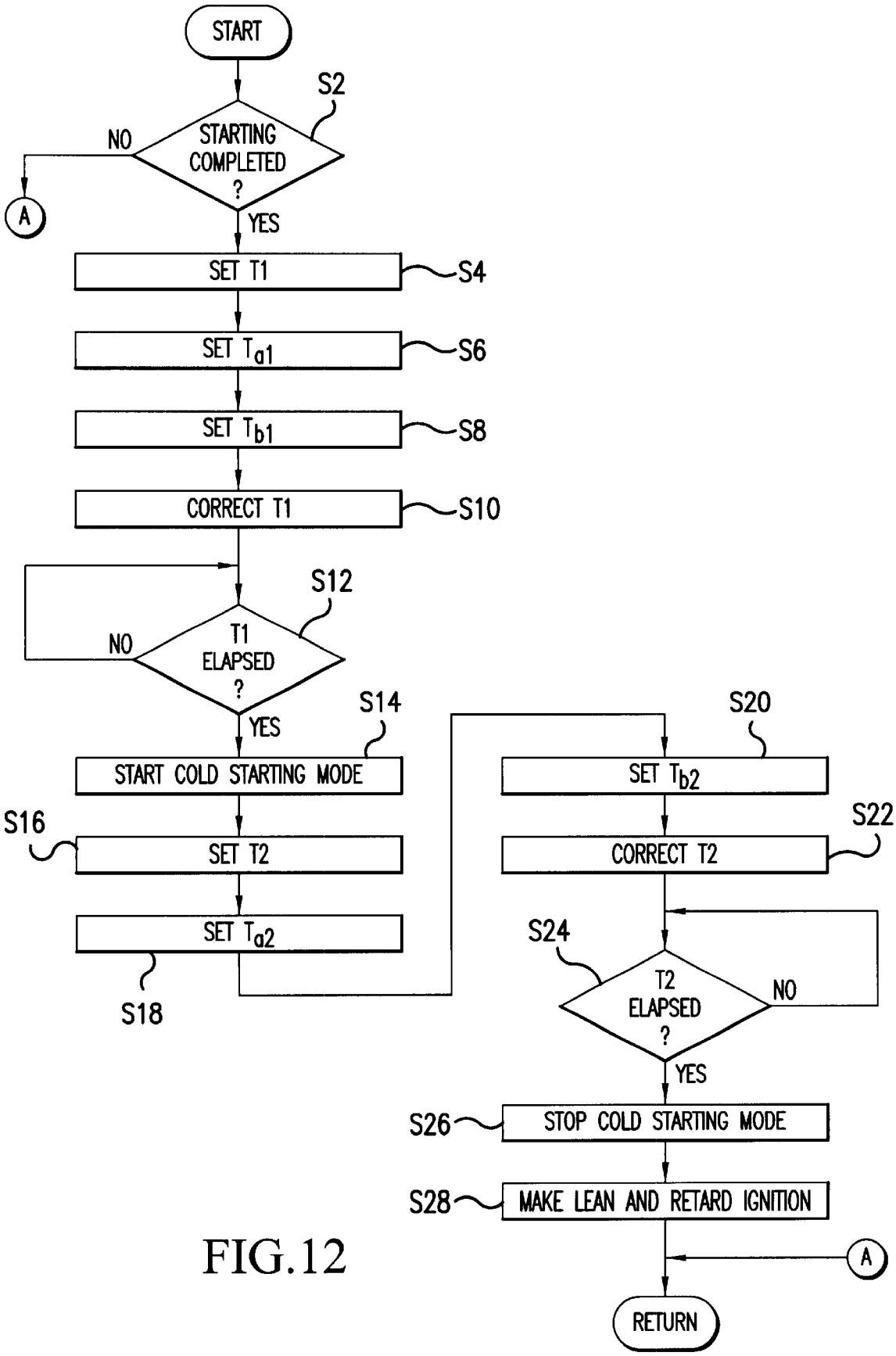
FIG. 12 is a flow chart showing a phase angle control routine performed by an ECU according to the fifth embodiment at the cold start of an engine.

On the other hand, if the engine 1 starts cranking, the ECU 31 performs the cold-starting phase control routine in FIG. 12 at regular control intervals, and determines first at step S2 whether the start of the engine 1 is complete or not. If the determination is positive, i.e. it is determined that the start of the engine 1 is complete, the program proceeds to step S4 to find a starting time T1, at which a cold starting mode is started, based on the cooling water temperature $T_w$ according to a map shown in FIG. 13. As is clear from FIG. 13, the lower the cooling water temperature is, the colder is the engine 1. The more difficult it is to raise the temperature of the intake port 11 and the exhaust passage 18, or the cylinder temperature, etc., the larger value is the starting time T1 (control delay means).

Figure 14:
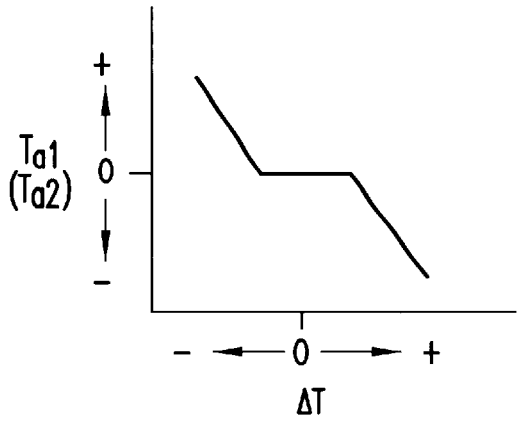
FIG. 14 is a map showing the relationship between a difference ΔT found by subtracting an oil temperature TO from an intake air temperature TA, and an intake air temperature correcting time $T_{a1}$.

At the next step S6, the ECU 31 finds an intake temperature correcting time $T_{a1}$ based on a difference ΔT found by subtracting the oil temperature TO from the intake temperature TA with reference to a map in FIG. 14. As is clear from FIG. 14, the smaller the difference ΔT on condition that the intake temperature T1 is lower than the oil temperature TO, i.e. the more difficult it is to facilitate the evaporation of the fuel, the larger positive value is the intake temperature correcting time $T_{a1}$. At next step S8, an engine speed correcting time $T_{b1}$ is found based upon a difference ΔNe found by subtracting the target engine speed TNe from the real engine speed Ne with reference to a map in FIG. 15. As is clear from FIG. 15, the smaller the difference ΔNe on condition that the actual engine speed Ne is lower than the target engine speed TNe, i.e. the less satisfactory the combustion of the fuel injected into the cylinder, the larger positive value is the engine speed correcting time $T_{b1}$.

At next step S10, the starting time T1 is corrected by adding the intake temperature correcting time $T_{a1}$ and the engine speed correcting time $T_{b2}$ thereto, and it is determined at step S12 whether the starting time T1 has elapsed since the completion of starting of the engine 1. If the determination is positive at the step S12, the cold starting mode is started at step S14 wherein the phase of the intake cam shaft 3*a* is advanced as indicated by [2] in FIGS. 10 and 11. This increases the overlap in the intake stroke range, and therefore, the exhaust gases having been discharged to the exhaust side flow back as the internal EGR into the intake port 11 and are combusted in the next combustion stroke, and the heat received from the exhaust gases flowing back facilitates the atomization of the fuel injected next. This surely inhibits the emission of the liquid fuel to the exhaust side.

If the cold starting mode is started too early, the temperature of the intake port 11 cannot be satisfactorily raised by the internal EGR to make it difficult to facilitate the atomization of the injected fuel since the exhaust temperature is low under the conditions that the fuel is difficult to evaporate and the fuel is not desirably combusted in the cylinder. Since the overlap is increased under these conditions, the liquid fuel may possibly be discharged to the exhaust side as described above.

According to the fifth embodiment, the lower the cooling water temperature $T_w$ and the more difficult it is to raise the temperature of each component of the engine 1, the larger value is the starting time T1 so that the start of the advance of the intake valve 7*a* can be delayed. Since this is taken into consideration as the correcting time $T_{a1}$, $T_{b1}$ to determine the starting time $T_1$ based upon the intake temperature TA and the engine speed Ne, the internal EGR accelerates the rise in the temperature of the intake port 11 and the opening and closing timing of the intake valve 7*a* is advanced as early as possible to control the emission of unburned HC.

The ECU 31 then finds a continuing time T2 of the cold starting mode at step S16, and finds the intake temperature correcting time $T_{a2}$ at step S18 and finds the engine speed correcting time $T_{b2}$ at step S20. The ECU 31 then corrects the continuing time T2 by adding the intake temperature correcting time $T_{a2}$ and the engine speed correcting time $T_{b2}$ thereto. Further, the ECU 31 determines at step S24 whether the continuing time T2 has elapsed since the start of the cold starting mode. If the determination is positive, the ECU 31 regards the temperature of the catalyst 20 as being raised to some extent and then stops the cold starting mode at step S26 to return the phase position of the intake cam shaft 3*a* to the retard position as indicated by [1] in FIGS. 10 and 11. At next step S28, the ECU 31 controls the air to fuel ratio to lean to control the emission of unburned HC and retards the ignition timing to maintain the high exhaust temperature to terminate the routine.

Figure 13:
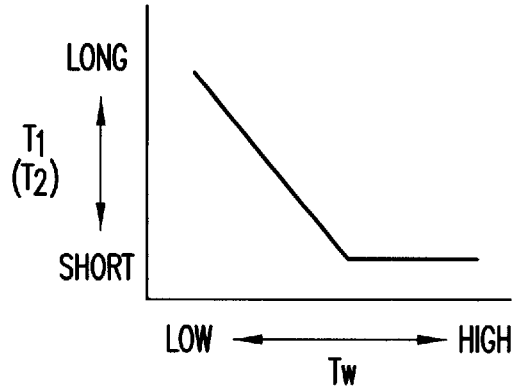
FIG. 13 is a map showing the relationship between a cooling water temperature $T_w$ and the second predetermined time according to the fifth embodiment.
Figure 15:
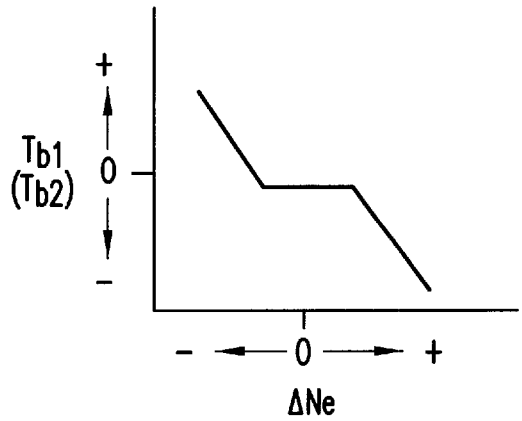
FIG. 15 is a map showing the relationship between a difference ΔNe found by subtracting a target engine revolutionary speed TNe from an actual engine revolutionary speed Ne, and an engine revolution correcting time $T_{b1}$.
Figure 16:
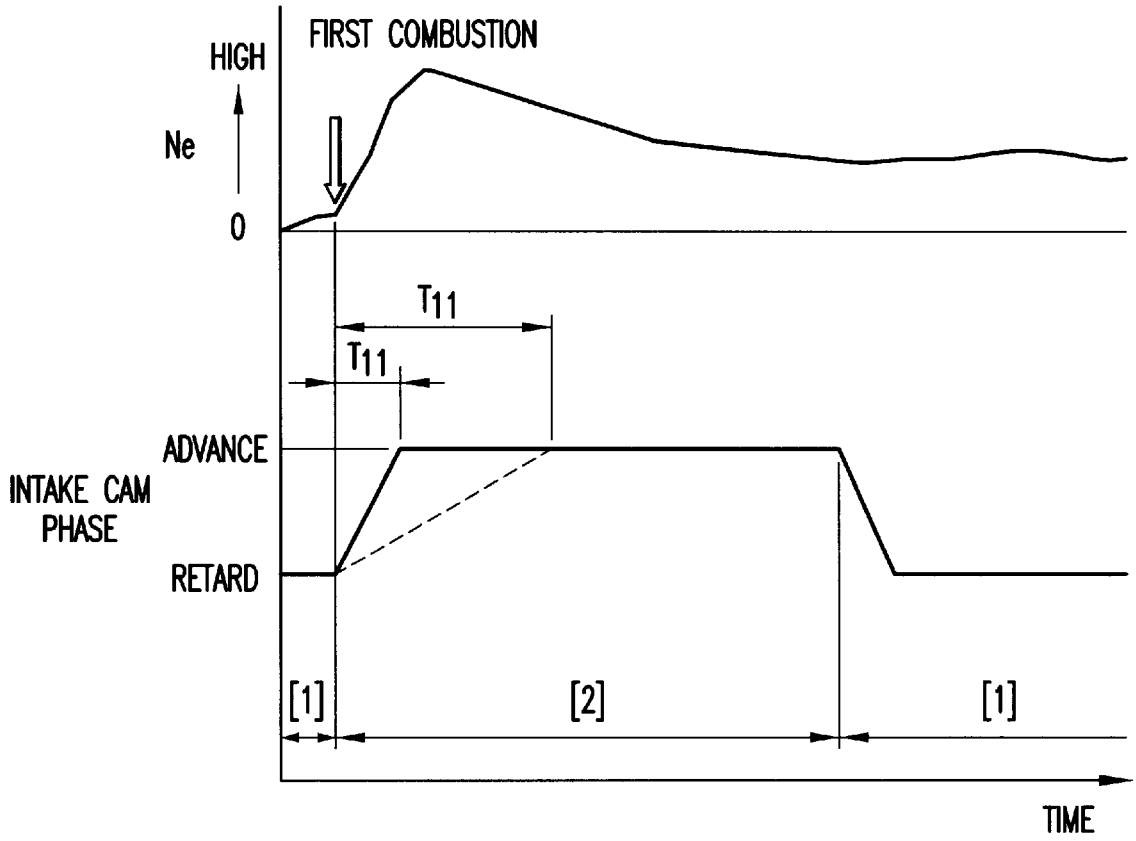
FIG. 16 is a time chart showing a controlling operation carried out in the case where a time when the variable valve timing apparatus according to the fifth embodiment changes the phase angle of the cam shaft is changed.

The map in FIG. 13 is used to determine the continuing time T2 at step Sl6, the map in FIG. 14 is used to determine the intake temperature correcting time $T_{a2}$ at step 518, and the map in FIG. 15 is used to determine the engine speed correcting time $T_{b2}$ at step S20. As a result, the timing for stopping the cold starting mode is determined according to the cooling water temperature $T_w$, the intake temperature TA, and the engine speed Ne to have the same characteristics as the timing for starting the cold starting mode. As is known, making the air to fuel ratio lean and retarding the ignition timing deteriorate the combustion of the fuel in the cylinder, and it is therefore necessary to start the cold starting mode at a point in time when the evaporation of the fuel is facilitated to some extent. If the temperature of the intake port 11 is slowly increased due to the low intake temperature TA, the continuing time T2 is corrected to increase according to the map in FIG. 14, and accordingly, the timing for starting making lean the air to fuel ratio and retarding the ignition is delayed to prevent the deterioration of combustion.

As described above, the variable valve timing apparatus according to the fifth embodiment starts the cold starting mode for raising the temperature of the intake port 11 by the internal EGR according to the cooling water temperature $T_w$ at the start of the engine 1. This prevents a trouble that occurs in the case where the cold starting mode is started too early, i.e. the discharge of the liquid fuel, and enables the start of the cold starting mode as early as possible to quickly raise the temperature of the intake port 11 to thereby surely control the emission of unburned HC.

Further, the cold starting mode starting time T1 is determined based upon the intake temperature TA indicating the evaporating condition of the fuel and the engine speed Ne indicating the combusting condition of the fuel in the cylinder, and this makes more suitable the cold starting mode starting timing to make the best use of the operation of the cold starting timing.

On the other hand, the timing for shifting the cold starting mode to the operations for making lean the air to fuel ratio and retarding the ignition is determined according to the operating state of the engine 1 (the cooling water temperature $T_w$, the intake temperature TA, the engine speed Ne, and the oil temperature TO), so that the operations for making the air to fuel lean and retarding the ignition can always be started at a proper timing. This prevents the deterioration of combustion and the resulting emission of unburned HC, which occur in the case where the operation is started too early.

Although the timing for starting and stopping the cold starting mode is changed according to the fifth embodiment, the timing for stopping the cold starting mode should not necessarily be changed but may be fixed at a predetermined timing.

Further, although in the fifth embodiment, the starting time T1 and the continuing time T2 are corrected based on the intake temperature correcting time $T_{a1}$, $T_{a2}$ and the engine speed correcting time $T_{b1}$, $T_{b2}$, the starting time T1 and the continuing time T2 may be corrected based on either one of the intake temperature correcting time $T_{a1}$, $T_{a2}$ and the engine speed correcting time $T_{b1}$, $T_{b2}$.

Further, although in the fifth embodiment, the timing for starting the advance of the intake valve 7*a* is changed according to the starting time T1, the timing for substantially advancing the opening and closing timing of the intake valve 7*a* may be changed by reducing a variable time T11 (i.e. the speed at which the intake valve 7*a* is advanced) while the timing for the ECU 31 serving as variable speed lowering means to start advancing the opening and closing timing of the intake valve 7*a* is fixed. In this case, the variable time T11 can be determined according to the cooling water temperature $T_w$, the intake temperature TA, the engine speed Ne, and the oil temperature TO in the same procedure as in the case where the starting time T1 is determined.

It should be understood, however, that there is no intention to limit the invention to the first to fifth embodiments disclosed, but to the contrary, the invention is to cover all modifications, alternate constructions, and equivalents falling within the spirit and scope of the invention as expressed in the appended claims.

For example, although in the above described embodiments, the vane timing changing mechanisms 8*a*, 8*b* are employed, this is not limitative thereto, but it is also possible to employ helical timing changing mechanisms, eccentric timing changing mechanisms that change the amount of eccentricity of cams with respect to cam shafts, switching timing changing mechanisms that selectively actuate cams having different characteristics, or electromagnetic timing changing mechanisms that directly open and close valves by means of an electromagnetic actuator.

Further, although in the above described embodiments, the present invention is applied to the intake port injection type engine 1, but the present invention may also be applied to a cylinder injection type engine that injects fuel directly into a cylinder. In this case, an overlap is formed in the intake stroke range to surely combust the fuel injected at a point in proximity to the TDC without discharging the fuel directly and thus control the emission of unburned HC as is the case with the above described embodiments.

What is claimed is:

1. A variable valve timing apparatus, comprising:

an exhaust valve that closes during an intake stroke after a top dead center succeeding an exhaust stroke;

an intake valve timing varying unit for selectively varying an open timing of the intake valve, said intake valve timing varying unit being capable of advancing the open timing of the intake valve such that the intake valve opens during the exhaust stroke; and a control unit for controlling said intake valve timing varying unit such that, at a cold start of an engine, an overlap in an open time between the exhaust valve and the intake valve lies in the intake stroke for a predetermined period of time, and such that the overlap lies in the exhaust stroke by advancing the open timing of the intake valve thereafter.

2. A variable valve timing apparatus according to claim 1, wherein a time period in which the overlap lies in the intake stroke is substantially longer than the time period in which the overlap lies in the exhaust stroke.

3. A variable valve timing apparatus according to claim 1, further comprising:

an operating state detecting unit for detecting an operating state of the engine; and a control delay unit for delaying a point of time at which said control unit begins to control said intake valve timing varying unit based on the detected operating state.

4. A variable valve timing apparatus according to claim 3, wherein said operating state detecting unit detects an engine temperature and at least one of an intake air temperature and an engine speed, and said control delay unit delays the point of time according to a reference value determined based on the detected engine temperature, said reference value being compensated by said at least one of the detected intake air temperature and the detected engine speed.

5. A variable valve timing apparatus according to claim 1, comprising:

an exhaust valve that closes during an intake stroke after a top dead center succeeding an exhaust stroke;

an intake valve timing varying unit for selectively varying an open timing of the intake valve, said intake valve timing varying unit being capable of advancing the open timing of the intake valve such that the intake valve opens during the exhaust stroke;

a control unit for controlling said intake valve timing varying unit such that, at a cold start of an engine, an overlap in an open time between the exhaust valve and the intake valve lies in the intake stroke, and such that the overlap lies in the exhaust stroke by advancing the open timing of the intake valve thereafter;

an operating state detecting unit for detecting an operating state of the engine; and a change speed reducing unit for reducing a speed at which said control unit changes the open timing of the intake valve based on the detected operating state.

6. A variable valve timing apparatus according to claim 5, wherein said operating state detecting unit detects an engine temperature and at least one of an intake air temperature and an engine speed, and said change speed reducing unit reduces the speed according to a reference value determined based on the detected engine temperature, said reference value being compensated by said at least one of the detected intake air temperature and the detected engine speed.

7. A variable valve timing apparatus according to claim 1, wherein the predetermined period of time is corrected based on engine speed.

8. A variable valve timing apparatus according to claim 1, wherein the predetermined period of time is corrected based on engine temperature.

9. A variable valve timing apparatus comprising:

an exhaust valve that closes during an intake stroke after a top dead center succeeding an exhaust stroke;

an intake valve timing varying unit for selectively varying an open timing of the intake valve, said intake valve timing varying unit being capable of advancing the open timing of the intake valve such that the intake valve opens during the exhaust stroke;

a control unit for controlling said intake valve timing varying unit such that, at a cold start of an engine, an overlap in an open time between the exhaust valve and the intake valve lies in the intake stroke, and such that the overlap lies in the exhaust stroke by advancing the open timing of the intake valve thereafter; and an exhaust valve timing varying unit for selectively varying controlling a close timing of the exhaust valve, said exhaust valve timing varying unit being capable of retarding the close timing of the exhaust valve such that the exhaust valve closes during the intake stroke, wherein said control unit controls said intake valve timing varying unit and said exhaust valve timing varying unit such that, at the cold start of the engine, the overlap in the open time between the exhaust valve and the intake valve lies in the intake stroke, and such that the overlap lies in the exhaust stroke by advancing the open timing of the intake valve thereafter.

10. A variable valve timing apparatus according to claim 9, wherein the overlap that lies in the exhaust stroke is increased while the control unit advances the close timing of the exhaust valve.

11. A variable valve timing apparatus according to claim 9, wherein said control unit advances the close timing of the exhaust valve after increasing the overlap that lies in the exhaust stroke.

12. A variable valve timing apparatus, comprising:

an exhaust valve that closes during an intake stroke after a top dead center succeeding an exhaust stroke;

an intake valve timing varying unit for selectively varying an open timing of the intake valve, said intake valve timing varying unit being capable of advancing the open timing of the intake valve such that the intake valve opens during the exhaust stroke; and a control unit for controlling said intake valve timing varying unit such that, at a cold start of an engine, an overlap in an open time between the exhaust valve and the intake valve lies in the intake stroke, and such that the overlap lies in the exhaust stroke by advancing the open timing of the intake valve thereafter, wherein said control unit maintains the overlap at zero until the overlap that lies in the intake stroke is established.

13. A variable valve timing apparatus, comprising:

an exhaust valve that closes during an intake stroke after a top dead center succeeding an exhaust stroke;

an intake valve timing varying unit for selectively varying an open timing of the intake valve, said intake valve timing varying unit being capable of advancing the open timing of the intake valve such that the intake valve opens during the exhaust stroke; and a control unit for controlling said intake valve timing varying unit such that, at a cold start of an engine, an overlap in an open time between the exhaust valve and the intake valve lies in the intake stroke, and such that the overlap lies in the exhaust stroke by advancing the open timing of the intake valve thereafter, wherein said control unit changes from the overlap that lies in the intake stroke to the overlap that lies in the exhaust stroke at a predetermined time after a first combustion of the engine.

14. A method of varying a valve timing, comprising:

controlling an open timing of an intake valve such that, at a cold start of an engine, an overlap in an open time between an exhaust valve and the intake valve lies in an intake stroke after a top dead center succeeding an exhaust stroke for a predetermined period of time; and controlling the open timing of the intake valve such that the overlap lies in the exhaust stroke by advancing the open timing of the intake valve thereafter.

15. The method of claim 14, further comprising:

maintaining a time period in which the overlap lies in the intake stroke substantially longer than a time period in which the overlap lies in the exhaust stroke.

16. The method of claim 14, further comprising:

detecting an operating state of the engine; and delaying at least one of the steps of controlling the open timing of the intake valve based on the detected operating state.

17. The method of claim 16, wherein said detecting step includes the step of, detecting an engine temperature and at least one of an intake air temperature and an engine speed, and said delaying step includes the step of, delaying a point of time at which the intake valve open timing is controlled according to a reference value determined based on the detected engine temperature, said reference value being compensated by said at least one of the detected intake air temperature and the detected engine speed.

18. The method of claim 14, further comprising the step of:

detecting an engine speed; and correcting the predetermined period of time based on the detected engine speed.

19. The method of claim 14, further comprising the step of:

detecting an engine temperature; and correcting the predetermined period of time based on the detected engine temperature.

20. A method of varying a valve timing comprising:

controlling an open timing of an intake valve such that, at a cold start of an engine, an overlap in an open time between an exhaust valve and the intake valve lies in an intake stroke after a top dead center succeeding an exhaust stroke;

controlling the open timing of the intake valve such that the overlap lies in the exhaust stroke by advancing the open timing of the intake valve; and maintaining the overlap at zero until the overlap that lies in the intake stroke is established.

21. A method of varying a valve timing, comprising:

controlling an open timing of an intake valve such that, at a cold start of an engine, an overlap in an open time between an exhaust valve and the intake valve lies in an intake stroke after a top dead center succeeding an exhaust stroke;

controlling the open timing of the intake valve such that the overlap lies in the exhaust stroke by advancing the open timing of the intake valve; and increasing the overlap that lies in the exhaust stroke while the close timing of the exhaust valve is being advanced.

22. A method of varying a valve timing comprising controlling an open timing of an intake valve such that, at a cold start of an engine, an overlap in an open time between an exhaust valve and the intake valve lies in an intake stroke after a top dead center succeeding an exhaust stroke;

controlling the open timing of the intake valve such that the overlap lies in the exhaust stroke by advancing the open timing of the intake valve; and changing from the overlap that lies in the intake stroke to the overlap that lies in the exhaust stroke at a predetermined time after a first combustion of the engine.

23. A method of varying a valve timing comprising:

controlling an open timing of an intake valve such that, at a cold start of an engine, an overlap in an open time between an exhaust valve and the intake valve lies in an intake stroke after a top dead center succeeding an exhaust stroke;

controlling the open timing of the intake valve such that the overlap lies in the exhaust stroke by advancing the open timing of the intake valve; and advancing the close timing of the exhaust valve after increasing the overlap that lies in the exhaust stroke.

24. A method of varying a valve timing, comprising:

controlling an open timing of an intake valve such that, at a cold start of an engine, an overlap in an open time between an exhaust valve and the intake valve lies in an intake stroke after a top dead center succeeding an exhaust stroke;

controlling the open timing of the intake valve such that the overlap lies in the exhaust stroke by advancing the open timing of the intake valve;

detecting an operating state of the engine; and reducing a speed at which the open timing of the intake valve is changed based on the detected operating state.

25. The method of claim 24, wherein said detecting step includes the step of, detecting an engine temperature and at least one of an intake air temperature and an engine speed, and said reducing step includes the step of, reducing the speed according to a reference value determined based on the detected engine temperature, said reference value being compensated by said at least one of the detected intake air temperature and the detected engine speed.

* * * * *